US005104704A

United States Patent [19]

Labes et al.

[11] Patent Number: 5,104,704

[45] Date of Patent: Apr. 14, 1992

[54] GEL-INTERLEAVED TAMPER-EVIDENT WRAP

[75] Inventors: Mortimer M. Labes, Philadelphia, Pa.; Ranganath Parthasarathy, New Castle, Del.

[73] Assignee: Temple University, Philadelphia, Pa.

[21] Appl. No.: 594,282

[22] Filed: Oct. 9, 1990

[51] Int. Cl.[5] ..... B65D 65/16; B65D 30/08

[52] U.S. Cl. ..... 428/35.7; 428/36.92; 428/204; 428/459; 428/916; 206/459; 206/807; 215/203; 215/230; 215/232

[58] Field of Search ..... 428/916, 35.7, 36.92, 428/204; 206/807, 459; 215/203, 230, 232

[56] References Cited

U.S. PATENT DOCUMENTS

| | | | |
|---|---|---|---|
| 4,098,577 | 7/1978 | Halpern | 23/232 |
| 4,480,749 | 11/1984 | Laucis | 206/459 |
| 4,489,841 | 12/1984 | Thompson | 215/203 |
| 4,505,399 | 3/1985 | Weiner | 215/230 |
| 4,511,052 | 4/1985 | Klein | 215/230 |
| 4,516,679 | 5/1985 | Simpson et al. | 206/459 |
| 4,526,752 | 7/1985 | Perlman | 422/56 |
| 4,591,062 | 5/1986 | Sandhaus | 215/230 |
| 4,685,578 | 8/1987 | Dunshee | 215/230 |
| 4,816,305 | 3/1989 | Stillwell et al. | 428/35.7 |
| 4,905,851 | 3/1990 | Thompson | 215/203 |
| 4,986,429 | 1/1991 | Singleton, Jr. | 206/807 |

*Primary Examiner*—Ellis P. Robinson
*Assistant Examiner*—Rena L. Dye
*Attorney, Agent, or Firm*—Ratner & Prestia

[57] ABSTRACT

A tamper evident over-wrap is disclosed which employs a multi-layered system including three overlapping layers of containment material and two interleaved layers of reactive material, at least one of which is a gel. Upon formation of an opening of the middle layer of containment material, the previously-isolated layers of reactive material will intermingle and react. These materials react to form a color change. By using a gel, manifestations of tampering attempts are considerably enhanced.

17 Claims, 2 Drawing Sheets

GEL-INTERLEAVED TAMPER-EVIDENT WRAP

FIELD OF THE INVENTION

This invention relates generally to tamper evident wraps for containers and, more particularly, to tamper evident wraps which undergo a color change to indicate tampering.

BACKGROUND

Recent instances of tampering with retail products have increased the need for a flexible, irreversible system which would clearly indicate tampering of the contents of a container. Tamper evident wraps including entrapped reactants which combine and undergo a color change upon disruption or penetration of the wrap have previously been proposed. The present invention is an improvement on such wraps.

SUMMARY OF THE INVENTION

In accordance with the present invention, a multiple-layered tamper evident wrap includes three layers of containment material. These layers are positioned on top of one another and contain two interspersed layers of reactive material. At least one and preferably both of these reactive layers are in gel form. The middle containment layer separates the layers of reactive material from each other. The layers of containment material are bonded at their common edges to completely encompass and isolate each layer of reactive material.

Upon tampering, an opening in the middle layer of containment material results in contact between the reactive materials formerly entrapped on the two sides of the middle containment layer. This contact causes the two layers of reactive material to react and form a color change. Of course, the outer containment layer must be transparent so that the color change is apparent.

Because at least one of the reactive layers is in gel form, this invention provides for several advantages not found in the prior art. In particular, the manifestation of tampering is considerably enhanced because the viscosity of gels may be modified to optimize the spatial extent of color development. This optimization results in a lateral spread of the color change through the gel layer. As compared to liquid form entrapped reactants, the gel form of reactant also minimizes the possibility of collapse of the entrapped reactive layer at corners or edges of the container about which the wrap makes a sharp radius and over flat surfaces, even upon attempted impression by a flat object.

In one embodiment, the gel layer includes an indicator, which undergoes a color change at predetermined pH values. The pH values of the reactive materials are adjusted such that addition of material from the second reactive layer to the gel layer will result in a color change. A second pH indicator may also be included to indicate any possible attempt to mask intrusion by introduction of a pH reversal reactant.

DETAILED DESCRIPTION OF INVENTION

Figure 1:
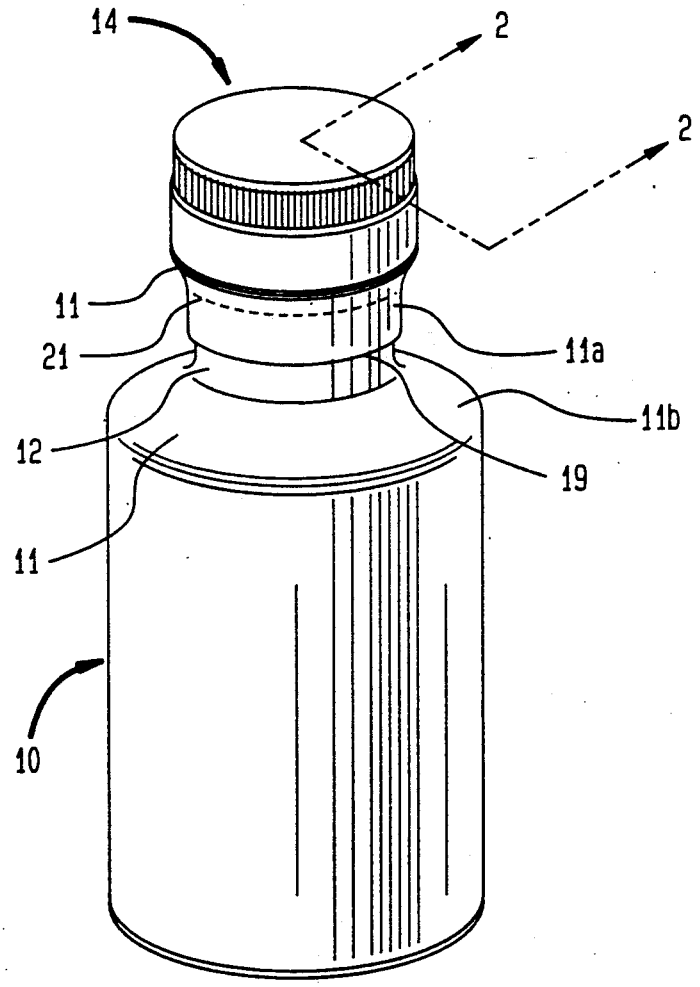
FIG. 1 is a perspective view of a container, enveloped by a transparent tamper evident wrap, in accordance with this invention.

As shown in FIG. 1, a transparent tamper evident wrap 11, including an upper portion 11*a* and a lower portion 11*b*, encompasses container 10. Lower portion 11*b* covers the bottom of container 10 and is wrapped upward around the circumference of the container to a circular edge 21 on neck 12. Upper portion 11*a* is then wrapped downward over cap 14 and neck 12 and extends past edge 21 of lower portion 11*b* to a circular edge 19. Thus, this configuration results in complete coverage of container 10 and cap 14 by tamper evident wrap 11.

Alternatively, a single wrap having no edges may be shrunk in place around an entire container, or, if complete coverage is not desired, the wrap may be used to cover only the cap or only a portion of the container. Also, the wrap may be placed inside of a container and/or cap; in this configuration, the container and/or cap must be transparent.

Figure 2:
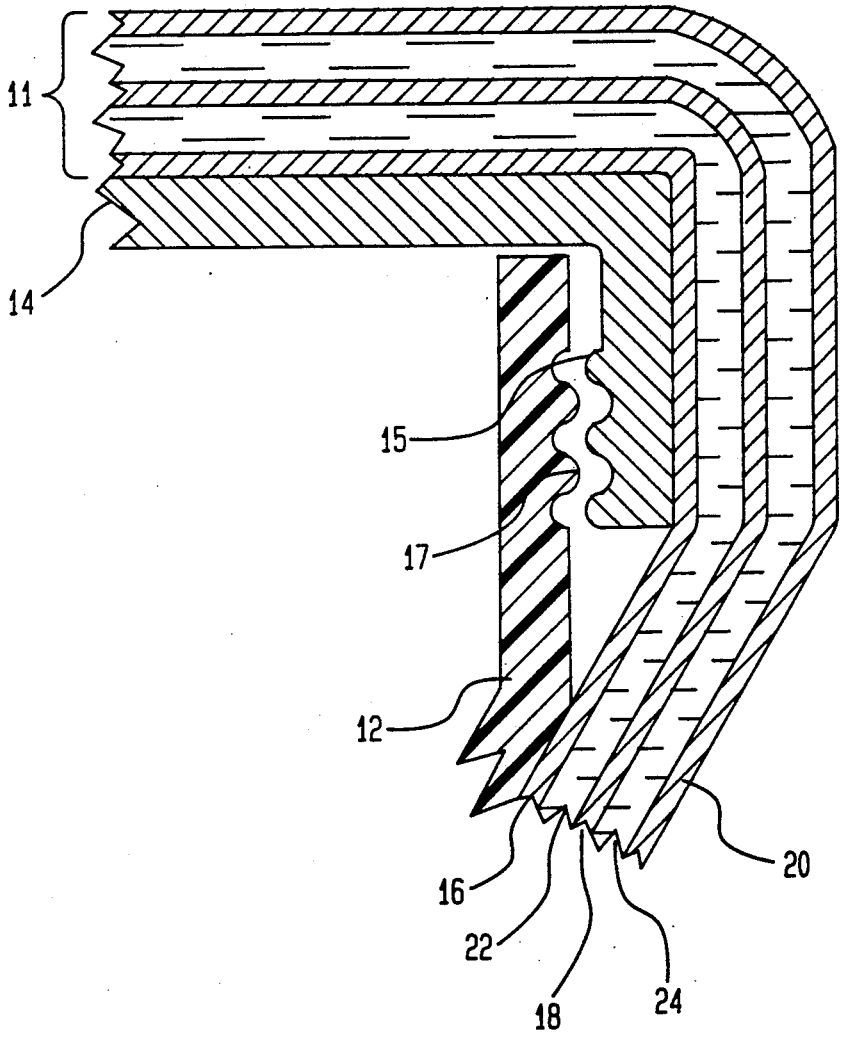
FIG. 2 is an expanded, detailed cross-sectional view, not drawn to scale, of the container, its cap, and the tamper evident wrap shown in FIG. 1, in the segmented plane 2—2.

The details of tamper evident wrap 11 are better seen in FIG. 2. In order to properly exhibit the details of tamper evident wrap 11, FIG. 2 is not drawn to scale; in actuality, neck 12 and cap 14 would be relatively thicker, as compared with wrap 11, than is shown.

Tamper evident wrap 11 includes five layers, 16, 18, 20, 22, and 24. These layers consist of 3 layers of containment materials:

a. Inner containment layer 16,
b. middle containment layer 18, and
c. transparent outer containment layer 20; and 2 layers of reactive materials:
d. Inner reactive layer 22 and
e. outer reactive layer 24.

As shown in FIG. 2, the five layers are positioned on top of one another. Reactive layers 22 and 24, which contact middle containment layer 18, are isolated from the contents of container 10 and the environment and are separated from each other by middle containment layer 18. In particular, outer containment layer 20 and middle containment layer 18 envelop and isolate outer reactive layer 24. Similarly, middle containment layer 18 and inner containment layer 16 envelop and isolate inner reactive layer 22.

An opening in middle containment layer 18, such as would be made by a hypodermic needle, will result from attempted tampering through an area of container 10 which is covered by tamper evident wrap 11. Upon the formation of an opening in middle containment layer 18, reactive material from one reactive layer migrates through the opening and mixes with the other reactive layer. Upon contact, these reactive layers 22 and 24 react to form a color change, which is apparent due to the transparency of outer containment layer 20.

In accordance with this invention at least one of the reactive layers 22 or 24, and preferably both, must be a gel. Preferably, the viscosities of these gels should be sufficiently high to minimize the possibility of collapse of the wrap, but sufficiently low to permit migration of the reactive materials through an opening in middle containment layer 18. Within this range, the viscosity may be adjusted to produce a desired hue in the reacted gel and also to control the spatial extent of the color change.

In one embodiment, the gel is a thixotropic gel prepared by dissolving a 6 w/v % solution of porcine gelatin, with a bloom strength of 250, in 20 mL of distilled water at 55° F. Alternatively, gelatin may be replaced by agar, hydrophilic cellulose derivative, neutralized sodium silicate or polyvinyl alcohol.

As noted earlier, reactive layers 22 and 24 react to form a color change. One reactive layer may include an indicator, which undergoes a color change at a predetermined pH value. The pH of this reactive layer is adjusted so that a color change is easily triggered by the addition of a relatively acidic material or a relatively alkaline material. For these purposes, "relatively alkaline material" means any reactive material sufficiently alkaline to cause the other reactive material to change color upon contact. Similarly, "relatively acidic material" means any reactive material sufficiently acidic to cause the other reactive material to change color upon contact.

Thus, the pH of the indicator-containing reactive material must either be just above or just below the predetermined pH value at which the indicator changes color. A variety of indicators may be used, including methyl red, phenolphthalein, bromothymol blue, or Alizarin. Preferably, this reactive material is a gel and is outer reactive layer 24. This configuration results in the best mixing of the reactive layers and spontaneous color formation as the tampering device is being withdrawn.

In one embodiment, the indicator phenolphthalein is contained in one reactive layer, referred to as the "indicator - containing material." Phenolphthalein changes from colorless to magenta at a range of pH values from 8.0 to 10.0. If a color change from colorless to magenta is desired, the pH of the indicator - containing material is set, for example at about 7.9 and the other reactive material will be a relatively alkaline material, i.e. a material with a pH of 8.5 or above. Thus, upon addition of the relatively alkaline material, the indicator containing material's color will change from colorless to magenta. Alternatively, if a color change from magenta to colorless is desired, the pH of the indicator - containing material would preferably be set at 10.1 or above and the other reactive material would be, a relatively acidic material, i.e. a material with a pH of 7 or below. Thus, upon addition of the relatively acidic material, the indicator—containing material's color will change from magenta to colorless. Other indicators may be used analogously, such as: Bromothymol blue, which changes from pale yellow to blue at a range of pH values from 6.0 to 7.5; alizarin, which changes from pale yellow to violet at a range of pH values from 5.8 to 7.2 or methyl red, an acid-sensitive indicator, which changes from red to yellow at a range of pH values from 4.4 to 6.2.

An auxiliary pH indicator may be added to the indicator—containing material to make it difficult to mask any prior tampering. For example, if the tamper evident wrap 11 includes the combination of reactive material layers which results in a color change of the indicator—containing material from yellow to blue, as discussed above. Theoretically, this color change may be reversed by inserting a sufficient amount of acid into the indicator—containing material to decrease the reactive material's pH below 6.0; then, the reactive material would again be yellow. However, this masking process is rendered nearly impossible to execute by adding an indicator which undergoes a color change at a pH value just below 6.0, the pH of the indicator—containing material. Thus, excursions in pH of either direction would result in a color change. This result is achieved in the above example by adding methyl red to the indicator—containing material. Similarly, this process may also be used if the configuration of reactive materials is such that the indicator—containing reactive material undergoes a color change upon a decrease in pH. In this configuration, the second indicator would undergo a color change above the pH of the indicator—containing material.

As previously noted, the reactive material that does not include an indicator may be either a relatively acidic material or a relatively alkaline material, depending on which type of color change is desired. It also may either be a liquid or a gel, but a gel is preferred. If a gel, it may be prepared by dissolving 3–6 w/v % of porcine gel in 20 mL of distilled water at 55° F. Preferably, 3 w/v % porcine gel is used as it yields the fastest reaction rates. Concentrated (10 M) NaOH and HCl are used as the pH modifying substances. At pH values greater than 9, one or two drops of formalin may be used to enhance gelation. However, at pH values above 11, gelation is difficult even with the use of formalin. Alternatively, a glycerol/distilled water mixture may a be used to increase the viscosity of the gel.

One method of making tamper evident wrap 11 is to first place some reactive material between two layers of containment material, for example inner containment layer 16 and middle containment layer 18. Then, the edges of those two layers of containment material are bonded together. An amount of the other reactive material is placed on top of this sandwich. The quantities of reactive materials used need not be the same, but must be sufficient to allow for mixing upon the formation of an opening at any point in middle containment layer 18. Then, a third layer of containment material, i.e. outer containment layer 20, is placed on top of this reactive material, and the edges of the third containment layer are bonded to the previously bonded edges of the other two layers of containment materials. The thickness of the containment layers may be varied to suit the application. The gel layer thickness may likewise be varied, but is best limited to 2 or 3 mm.

The containment material must be flexible enough to generally conform to the shape of a given cap or container and have properties enabling it to be conformed or adhered to the outer surface of the container. Polyethylene, for example, may be used as the containment material. Outer containment layer 20 must be transparent, while inner containment layer 16 and middle containment layer 18 may or may not be transparent. For example, middle containment layer 18 may be white, so that a color change in outer reactive layer 24 would be apparent against the white background. In the instance where middle containment layer 18 is not transparent, outer reactive layer 24 should be the indicator—containing material and a gel, because, in this configuration, the outer reactive layer is most likely to undergo a color change.

EXAMPLE 1

A relatively alkaline material was prepared by dissolving 3% (w/v) of porcine gelatin, with a bloom strength of 250, in 20 mL of distilled water at a temperature of 55° F. By using 10 M NaOH, the pH was adjusted to 10. One drop of formalin was added for gelation.

The indicator gel was prepared by dissolving 6% (w/v) of porcine gelatin in 20 mL of distilled water at a temperature of 55° F. Phenolphthalein and methyl red were added to this gel and its pH was set at 7.9. At this pH, the gel was yellow. The pH modifying substances used were 10 M NaOH and HCl.

A 4 cm×4 cm square of polyethylene was used as the containment material. About 0.5 grams of the alkaline gel were placed between two such squares, which were heat sealed at their edges, yielding a sandwich about 2 mm thick. A similar amount of the indicator gel was placed on top of this sandwich and covered by another piece of polyethylene, which was similarly bonded to the other two sheets at its edges.

A fine hypodermic needle was inserted through the five layers. The color changed virtually instantaneously to magenta and spread quickly and uniformly throughout the gel layer. Although the color change dulled over the course of a few days at room temperature, it still remained quite evident.

While several embodiments of the invention have been described in detail herein and illustrated in the accompanying drawings, further modifications of the invention may be obvious to one skilled in the art. These further modifications and their equivalents are understood to be encompassed within the scope of the following claims.

What is claimed is:

1. A tamper evident wrap for a container, comprising:
   a. three over-lapping layers of containment material: a transparent outer containment layer situated farthest from the container, a middle containment layer, and an inner containment layer situated closest to the container, and
   b. two layers of two separate reactive materials separated by said layers of containment material bonded at their edges to completely encompass and isolate each layer of reactive material: an inner layer of one of said reactive materials contained between said inner containment layer and said middle containment layer and an outer layer of the other of said reactive materials contained between said outer containment layer and said middle containment layer, which reactive materials are separated from one another by said middle containment layer and are in contact with said middle containment layer, wherein:
      i. at least one of said reactive materials is a gel,
      ii. the other of said reactive materials is capable, upon formation of an opening formed by tampering in said middle containment layer, of migrating through said opening and spreading laterally through said reactive gel layer, and
      iii. said separate reactive materials are capable to undergoing a color change upon contact with one another.

2. A tamper evident wrap of claim 1, wherein said wrap covers a cap of said container.

3. A tamper evident wrap of claim 1, wherein said wrap covers substantially all of said container.

4. A tamper evident wrap of claim 1, wherein said wrap covers the entire container, including a cap of said container.

5. A tamper evident wrap of claim 1, wherein said middle containment layer is transparent.

6. A tamper evident wrap of claim 1, wherein said inner containment layer is transparent.

7. A tamper evident wrap of claim 1, wherein said containment material is polyethylene.

8. A tamper evident wrap of claim 1, wherein both layers of reactive material are gel layers.

9. A tamper evident wrap of claim 1, wherein said gel comprises a 3-6 (w/v) % porcine gel dissolved in distilled water.

10. A tamper evident wrap of claim 1, wherein one of said reactive materials includes an indicator which undergoes a color change at a predetermined pH.

11. A tamper evident wrap of claim 10, wherein said indicator is methyl red, phenolphthalein, bromothymol blue, or alizarin.

12. A tamper evident wrap of claim 10, wherein said indicator—containing material is a gel.

13. A tamper evident wrap of claim 10, wherein said indicator—containing reactive material is the outer reactive layer.

14. A tamper evident wrap of claim 1, wherein:
   c. one of said reactive materials includes an indicator which undergoes a color change at a predetermined pH and the pH of said indicator—containing material is above said predetermined pH, and
   d. the pH of the other reactive material is below said predetermined pH.

15. A tamper evident wrap of claim 1, wherein:
   c. one of said reactive materials includes an indicator which undergoes a color change at a predetermined pH and the pH of said indicator—containing material is below said predetermined pH, and
   d. the pH of the other material is above said predetermined pH.

16. A tamper evident wrap of claim 14, wherein said indicator—containing reactive material further includes a second indicator which undergoes a color change at a second predetermined pH, said first predetermined pH being between the two pH values of said reactive materials and said second pre-determined pH being above the pH of said indicator—containing reactive material.

17. A tamper evident wrap of claim 15, wherein said indicator—containing reactive material further includes a second indicator which undergoes a color change at a second predetermined pH, said first predetermined pH being between the two pH values of said reactive materials and said second pre-determined pH being below the pH of said indicator—containing reactive material.

* * * * *